US005810055A

United States Patent [19]

Haeussler et al.

[11] Patent Number: 5,810,055

[45] Date of Patent: Sep. 22, 1998

[54] HEALD SHAFT POWER DRIVEN COUPLING WITH A DECOUPLING DEVICE

[75] Inventors: Horst Haeussler, Lindau; Valentin Krumm, Hergensweiler, both of Germany

[73] Assignee: Lindauer Dornier Gesellschaft mbH, Lindau, Germany

[21] Appl. No.: 780,056

[22] Filed: Dec. 23, 1996

[30] Foreign Application Priority Data

Dec. 27, 1995 [DE] Germany ..... 195 48 848.2

[51] Int. Cl.[6] ..... D03C 9/00; D03C 1/14

[52] U.S. Cl. ..... 139/57; 403/31; 403/322; 292/341.16

[58] Field of Search ..... 403/31, 321, 322; 139/57; 292/341.16

[56] References Cited

U.S. PATENT DOCUMENTS

| | | | |
|---|---|---|---|
| 4,365,653 | 12/1982 | Freisler et al. | 139/57 |
| 4,369,815 | 1/1983 | Gehring et al. | 139/57 |
| 4,541,459 | 9/1985 | Palau | 139/57 X |
| 4,902,156 | 2/1990 | Deisler et al. | 139/57 |
| 4,940,362 | 7/1990 | Paulshus et al. | 403/322 |
| 5,063,971 | 11/1991 | Peter | 139/57 |
| 5,348,053 | 9/1994 | Oerti | 139/57 |
| 5,518,040 | 5/1996 | Rupflin . | |

FOREIGN PATENT DOCUMENTS

| | | | |
|---|---|---|---|
| 0 598 161 | 5/1994 | European Pat. Off. | 139/57 |
| 0598162 | 5/1994 | European Pat. Off. . | |
| 0598167 | 5/1994 | European Pat. Off. . | |
| 3541042 | 1/1987 | Germany . | |

*Primary Examiner*—Andy Falik
*Attorney, Agent, or Firm*—W. F. Fasse; W. G. Fasse

[57] ABSTRACT

A multitude of heald shafts can be decoupled simultaneously as a set. For this purpose one of the two coupling sections (2, 3) of a shaft, either the section on the push rod side or the section on the shaft side, is equipped with a decoupling mechanism (11). All decoupling mechanisms (11) are power operated in unison by hydraulic, pneumatic, or electrical power. The power operated decoupling mechanisms operate a spring biased rocker lever (7) of a lever mechanism (6) to decouple the coupling sections from each other.

19 Claims, 6 Drawing Sheets

HEALD SHAFT POWER DRIVEN COUPLING WITH A DECOUPLING DEVICE

FIELD OF THE INVENTION

The invention relates to a heald shaft coupling with a decoupling device for separating a heald shaft from the shaft operating rods in weaving a loom. The invention also relates to a loom equipped with a multitude of heald shafts that can be simultaneously decoupled as a set from the operating rods for exchange by another set.

BACKGROUND INFORMATION

German Patent Publication DE-PS 4,343,882 (C1) corresponding to U.S. Pat. No. 5,518,040 (Rupflin), issued on May 21, 1996, discloses a mechanism for simultaneously coupling or uncoupling a plurality of heald shaft coupling devices in a loom. Such heald shaft couplings comprise two coupling unit sections. One coupling section is connected to the heald shafts. The other coupling section is connected to the operating rods. Each of the coupling sections includes a respective coupling element. The coupling element of the coupling section connected to the operating rods includes a lever mechanism biased by a tension spring. The lever mechanism includes a rocker lever having a free end carrying a roller for cooperation with a cam drive. The lever mechanism permits coupling of the two coupling units while preventing an unintended decoupling of these units from each other.

The heald shafts are arranged in packets so that for the purpose of a rational and effective exchange of the heald shafts can be carried out by lifting an entire shaft packet out of the loom or inserting an entire shaft packet into the loom, for example when a weaving pattern is to be changed. For this purpose of handling entire heald shaft packets, it is necessary that the shaft couplings not only permit such a simultaneous insertion and coupling of all the heald shafts with the operating rods, but that it is also possible to decouple all heald shafts from the operating rods in the same manner.

A simultaneous decoupling in the Rupflin mechanism requires a multitude of components in addition to the couplings for each shaft with a drive rod. Such a mechanism includes a rotationally driven positioning shaft which extends crosswise to the stroke motion direction of all individual heald shafts. The positioning shaft carries an operating element for decoupling each of the second coupling units on the operating rod side. All operating elements are rigidly secured to the positioning shaft and can be moved simultaneously through the lever mechanism into a position for cooperating with each of the respective rod side coupling units. Such a structure is quite effective, however, it requires a substantial effort and expense regarding materials and manufacturing consideration as well as assembly considerations.

OBJECTS OF THE INVENTION

In view of the above it is the aim of the invention to achieve the following objects singly or in combination:

to provide a decoupling mechanism for a heald shaft coupling which, compared to conventional decoupling devices, comprises fewer individual components and which, nevertheless, provides a high functional reliability while it can be produced in a cost effective manner;

to position the components required for the operation of the decoupling mechanism as close to the couplings as possible;

to construct the entire coupling system in such a way that the active operating rods are maintained in a position ready for coupling during a change of the type of weaving pattern while the temporarily passive operating rods are positively maintained in a rest position; and to provide the present coupling system with a safety device which stops the main loom drive in response to a faulty pattern programming, thereby preventing the activation of the passive operating rods.

SUMMARY OF THE INVENTION

The above objects have been achieved according to the invention by several embodiments or aspects of the invention. According to one aspect of the invention a decoupling mechanism is provided for releasing the coupling sections on the heald shaft side and on the operating rod side from each other. The decoupling mechanism cooperates with a lever mechanism that normally prevents a decoupling. The decoupling mechanism is power driven, for example, by a pneumatic power drive or a hydraulic power drive or an electric power drive or an electromagnetic power drive.

The invention also teaches using a coupling section equipped for connection to the operating rod, on the heald shaft side, and to use a coupling unit that is equipped for connection to the heald shaft side, on the operating rod side, whereby components of each heald shaft carry or incorporate the power supply line for the decoupling device. These power supply lines may be hydraulic or pneumatic pressure lines or electrical power lines. Where the power supply is from a source of hydraulic or pneumatic pressure, at least one heald shaft component itself may be constructed as a power supply line. According to the invention each pressure supply line is connected to a common source of pressure. Preferably a controllable closure valve is provided for all pressure supply lines in common.

The operating rods 10 according to the invention are equipped with components 22 that are connectable with a first or a second holding device 23, 24 rigidly mounted in a loom frame, whereby a connection between the loom frame and the operating rods is possible to arrest certain operating rods selectively in rest positions.

According to another aspect of the invention an activatable safety device 25 is arranged which stops the main loom drive in response to a faulty weaving program to thereby also stop the rotational drive of the positioning shaft, whereby an activation of any passive or arrested operating rods is automatically prevented.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

The present disclosure incorporates by reference the disclosure of U.S. Pat. No. 5,518,040, (Rupflin), which has been discussed above. Each heald shaft in a loom comprises for its operation a coupling mechanism divided into two coupling sections, one of which is positioned on the side of the heald shaft and the other is positioned on the side of the operating rods. These coupling sections can then be coupled to or decoupled from each other as necessary for exchanging one set or packet of heald shafts against another. The invention improves the known construction with a coupling unit provided with an integrated decoupling mechanism.

Figure 1:
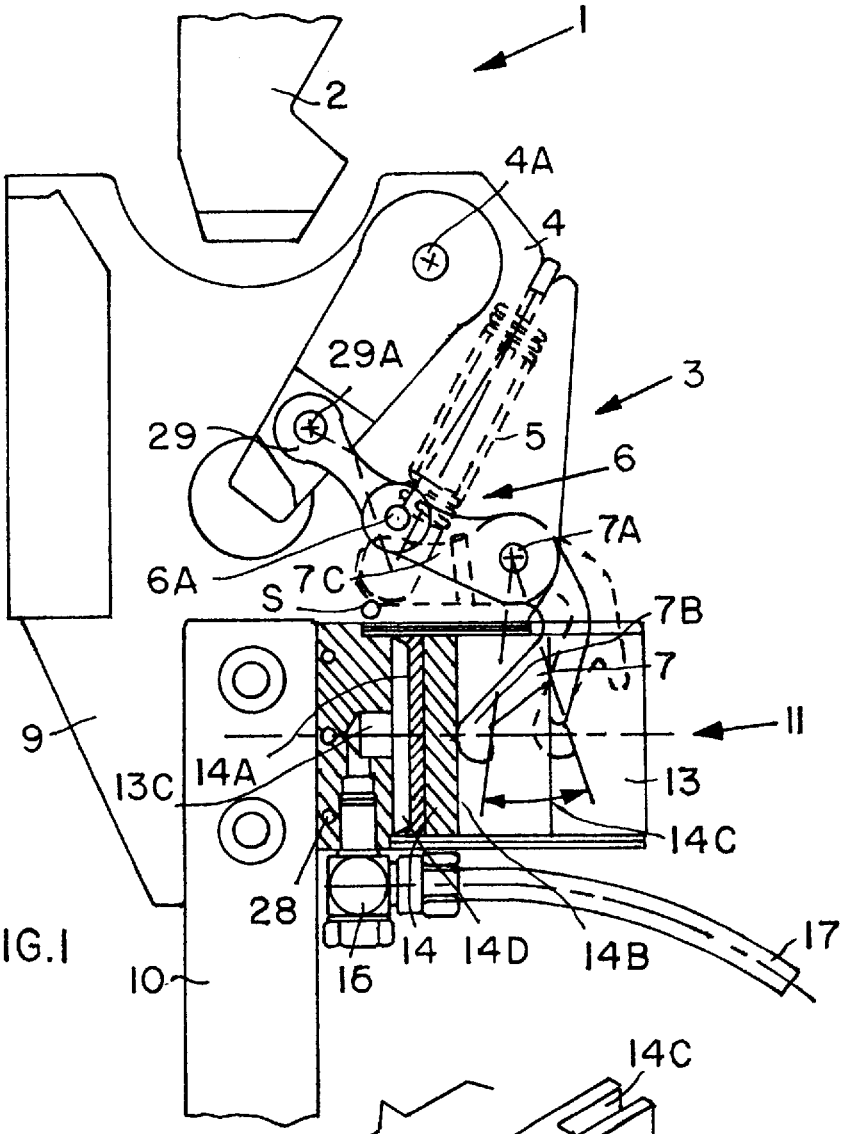
FIG. 1 is a side view shown partially in section of a coupling unit according to the invention forming part of a pressure operating coupling mechanism, whereby the coupling unit is arranged on the operating rod side.

FIG. 1 shows a coupling unit 1 having a first coupling section 2 arranged on the heald shaft side. The unit 1 further includes a second coupling section 3 arranged on and secured to an operating rod 10 for driving a respective heald shaft when the first and second coupling sections 2, 3 are coupled to each other. As shown, the coupling section 2 is disengaged or decoupled from the coupling section 3. Thus, drive power cannot be transmitted from the operating rod 10 to the respective heald shaft as long as the sections 2 and 3 remain decoupled.

Figure 3:
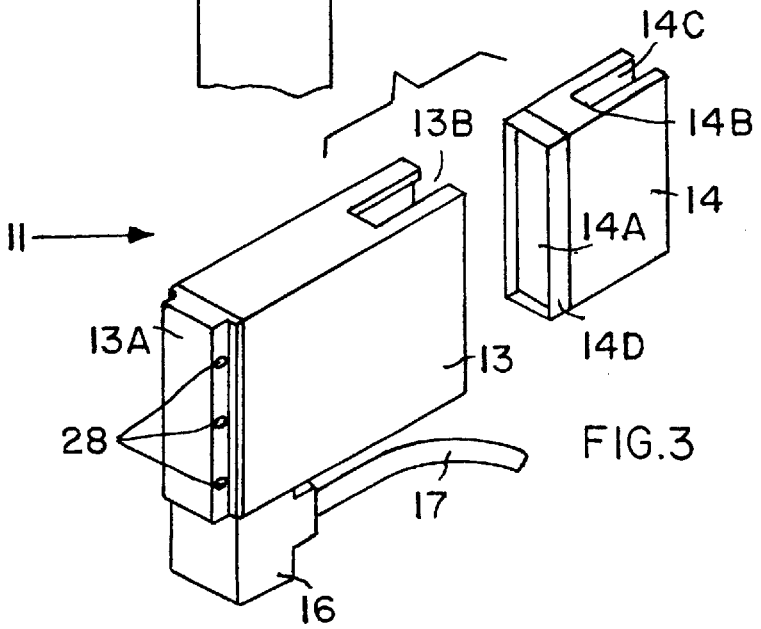
FIG. 3 illustrates a perspective view of a decoupling mechanism constructed as a guide housing with a pressure operated slider guided by the guide housing.

Referring to FIGS. 1 and 3, a decoupling mechanism 11 according to the invention is integrated into the second coupling section 3. In each instance, the decoupling mechanism 11 comprises a guide housing 13 in which a slider 14 is slidably received in a guided manner. The slider 14 has a first slider surface 14A exposed in the guide housing 13 to a pressurized medium such as air or a hydraulic fluid. A second slider surface 14B is arranged opposite the pressure exposed slider surface 14A. The slider 14 is insertable into its guide housing 13 so that the surface 14A is exposable to a pressurized medium through an inlet port 13C in the rear wall of the guide housing 13. This inlet port 13C is connected through fluid ducts and a coupler 16 to a pressure supply line 17. At least one pressure inlet port 13C is provided in the rear wall of the guide housing 13.

Referring to FIG. 1, rocker lever 7 of a lever mechanism 6 is mounted on a journal 7A in such a manner that its free end 7B can reach through a slot 14C in the slider 14 to bear against the surface 14B of the slider. A tension spring 5 biases the free end 7B of the rocker lever 7 against the surface 14B of the slider 14. The slider guide housing 13 is also provided with a slot 13B that registers with the guide slot 14C in the slider 14 when the latter is inserted in the guide housing 13 so that the free end 7B of the rocker lever 7 can engage the surface 14B even if the slider 14 is fully inserted in the guide housing 13. These slots 14C and 13B provide a lateral guiding for the clockwise and counterclockwise movements of the rocking lever free end 7B.

The decoupling mechanism 11 comprises the just described elements particularly the guide housing 13 and the slider 14 received in the guide housing 13. The guide housing 13 has at its rear side facing the viewer in FIG. 3 a mounting projection 13A provided with, for example threaded holes 28 for connection to the shaft operating rod 10 as shown in FIG. 1. Screws, not shown, are used for this connection of the decoupling mechanism 11 with the coupling section 3. A coupler, for example a quick release coupler 16, connects the pressure supply hose 17 to the inlet ducts in the guide housing 13 to feed fluid under pressure through the ports 13C. It is important in this connection that the positioning and mounting of the decoupling device 11 in the coupling section 3 makes sure that there is sufficient space between the guide housing 13 of the decoupling device 11 and the lever mechanism 6 for the proper rocking motion of the rocker lever 7 within the coupling section 3.

Figure 6:
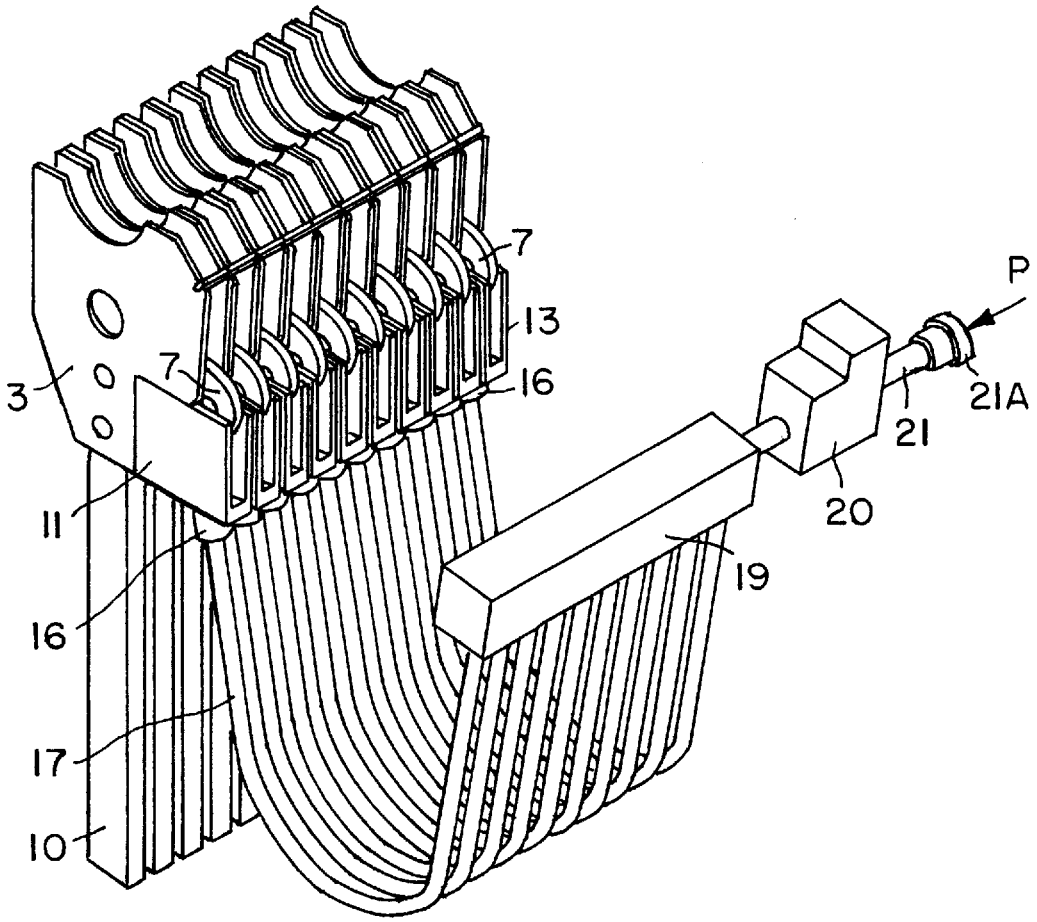
FIG. 6 illustrates perspectively a plurality of coupling units on the operating rod side with an integral decoupling mechanism connected through individual pressure lines such as flexible hoses to a pressure medium distributor provided in common for all pressure hoses.

The present decoupling mechanism operates as follows. FIG. 6 shows that each decoupling mechanism 11 is provided with its own pressure supply line or hose 17 which is connected at one end through the quick coupler 16 to the respective guide housing 13, and at the other end to a common pressure distributor 19 which in turn is connected through a pipe or hose 21 and a closure valve 20 to a source P of pressure shown only symbolically. When the chamber formed inside the guide housing 13 is pressurized through port or ports 13C, the slider 14 moves from left to right in FIG. 1, whereby the rocker lever 7 through its free arm 7B is turned counterclockwise around the journal shaft 7A. The other free end 7C of the rocker lever 7 causes the lever mechanism 6 to move into the dashed line position shown in FIG. 1, whereby a coupling element 4 is tilted about a journal axis 4A to bring the coupling element 4 into its decoupled position or state as shown in FIG. 1. The free or other end 7C of the rocker lever 7 is journalled at a journal 6A to a further coupling lever 29 which in turn is connected to the coupling element 4 by a journal 29A. The journal 6A coupling the lever arm 7C and the lever 29 to each other is also the connecting point for one end of the tension spring 5, thereby forming a toggle system. The full line position shown in FIG. 1 illustrates the coupling element 4 in a position ready for coupling. The dashed line position of the lever arm 7C shows the position that brings the coupling element 4 into a decoupled position. A stop S may be provided to positively limit a tilting range $\alpha$ of the rocker lever 7.

FIG. 1 does not show any heald shafts. However, in the shown position of the coupling element 4, the heald shafts are free for removal, for example for the purpose of changing the loom for weaving another article. The coupling operation takes place in a reverse manner compared to the above described operations, whereby, however, no pressure medium is applied in the chamber formed between the slider 14 and its guide housing 13 of the decoupling mechanism 11. Rather, pressurization is switched off, whereby the biasing spring 5 is able to permit the coupling element 4 to snap into the coupling section 2 positioned on and connected to the heald shaft. Preferably, the rear wall 14A of the slider 14 is surrounded by a rim 14D to form a space into which fluid under pressure is introduced through ports 13C.

Figure 2:
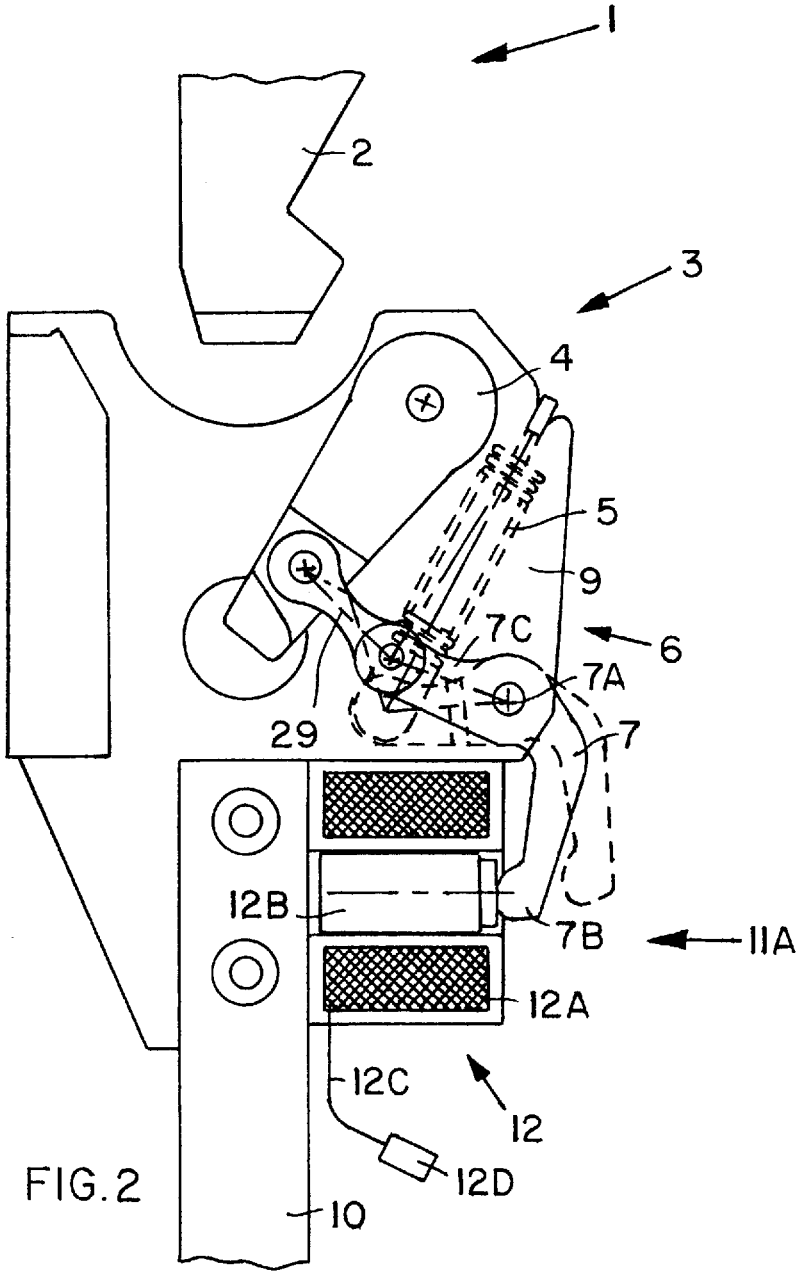
FIG. 2 is a view similar to that of FIG. 1, however illustrating the embodiment with an electromagnetic power drive for the decoupling mechanism arranged on the side of the operating rods.

FIG. 2 shows the same components as in FIG. 1, however, the decoupling mechanism 11A of this second embodiment of the invention is operated by an electromagnetic drive 12 for the rocker lever 7. The free end 7B of the rocker lever 7 rests against the right-hand end surface of an armature 12B of an electromagnet formed by a solenoid coil 12A. When the coil 12A is energized, the armature 12B moves to the right, thereby turning the rocker lever counterclockwise so that its other end 7C moves, as in FIG. 1 into the dashed line position. The effect of the counterclockwise movement of the rocker lever 7 is the same as described above, whereby a decoupling of the coupling sections 2 and coupling element 4 of section 3 is achieved. In FIG. 2 the solenoid 12A is not energized. However, the coil 12A of the solenoid electromagnetic drive 12 can be energized through an electric cable 12C and connector 12D.

Figure 4:
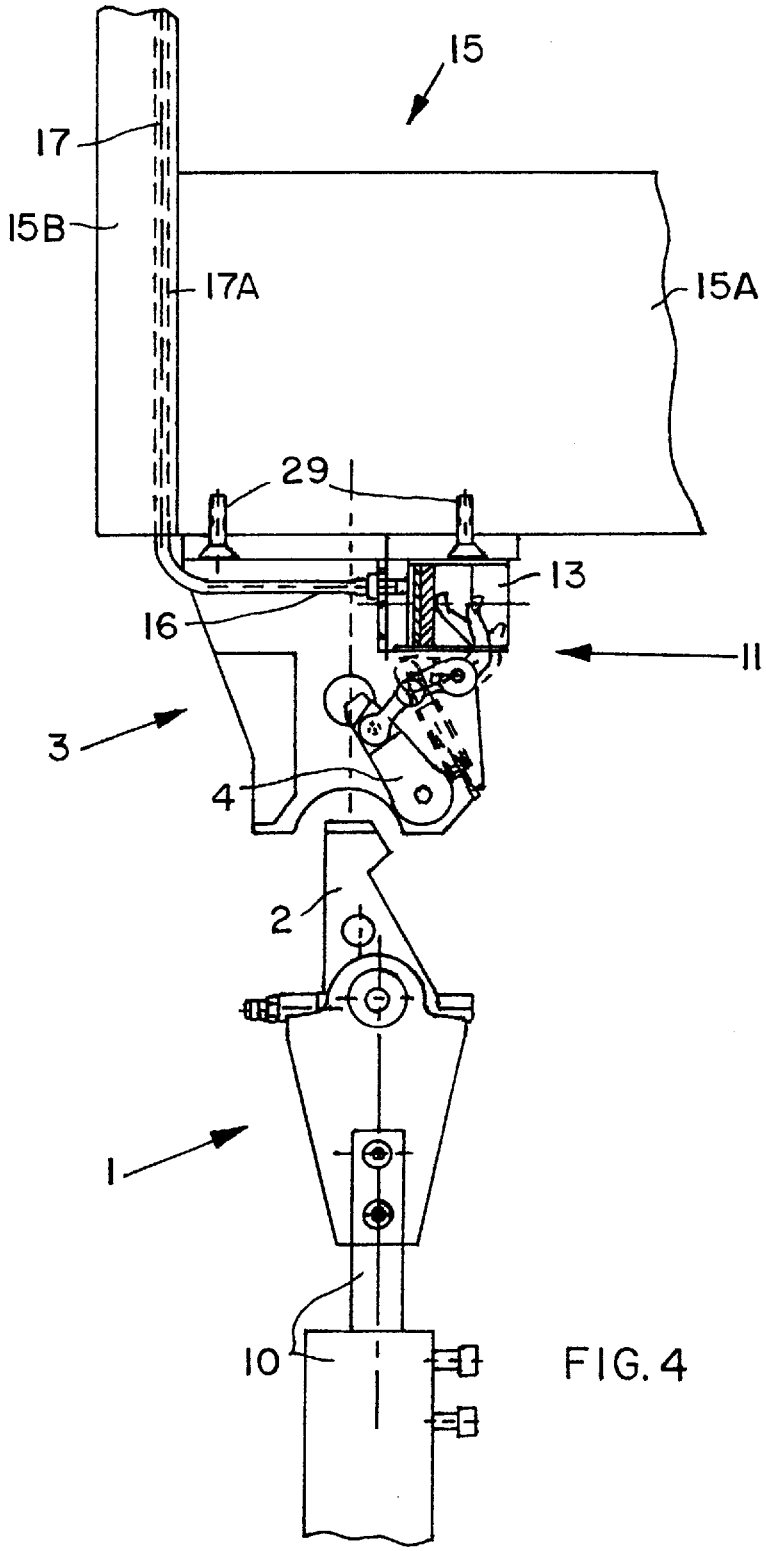
FIG. 4 shows the two coupling sections in a decoupled or opened state, wherein a coupling section equipped with a pressure operated decoupling mechanism is arranged on the heald shaft side, wherein the guide housing is shown in section.

FIG. 4 shows an embodiment of the invention wherein the coupling section 3 normally arranged on and connected to the operating rod 10 as shown in FIGS. 1 and 2, is now connected to the shaft side. More specifically, the coupling section 3 and its decoupling mechanism or device 11 are connected by screws 29 to a shaft bar 15A of the heald shaft 15. The quick coupler 16 for connecting the pressure supply line or hose 17 to the guide housing 13 of the decoupling mechanism 11 passes through the respective right and/or left lateral shaft bars or shaft sections 15A, 15B of the heald shaft 15. The upper end of the pressure conduit 17 may be connected through a connector 18 shown in FIG. 5 to a pressure source P as described above with reference to FIG. 6, preferably through a closure valve 20. FIG. 4 further shows that the coupling element 2 that is normally secured to the heald shaft, is now connected to the operating rod 10, such as push rod 10, as shown in FIG. 4. A conduit 17A for pressurized fluid may be formed directly in the shaft section 15B or 15A.

The advantage of the arrangement shown in FIG. 4 with the coupling section 3 secured to the shaft bar or section 15A and the pressure supply line 17 guided through between neighboring shaft bars 15B or forming a part thereof is that it is not necessary to employ a multitude of flexible pressure supply lines 17 as shown in FIG. 6, but a common supply line or chamber 19 shown in FIG. 6 can be used with short branch lines to the individual housings 13 of the decoupling mechanisms 11, 13. Thus, space is gained for a compact arrangement of all loom components. Another advantage is seen in that the decoupling mechanism 11 can be supplied with pressure medium from the outside, that is outside of the loom, so that this separate pressure medium or rather its source is switched on only when needed, for example when the loom is to be retooled for a change to weaving another fabric or pattern when it becomes necessary to decouple the heald shafts for their exchange.

Figure 5:
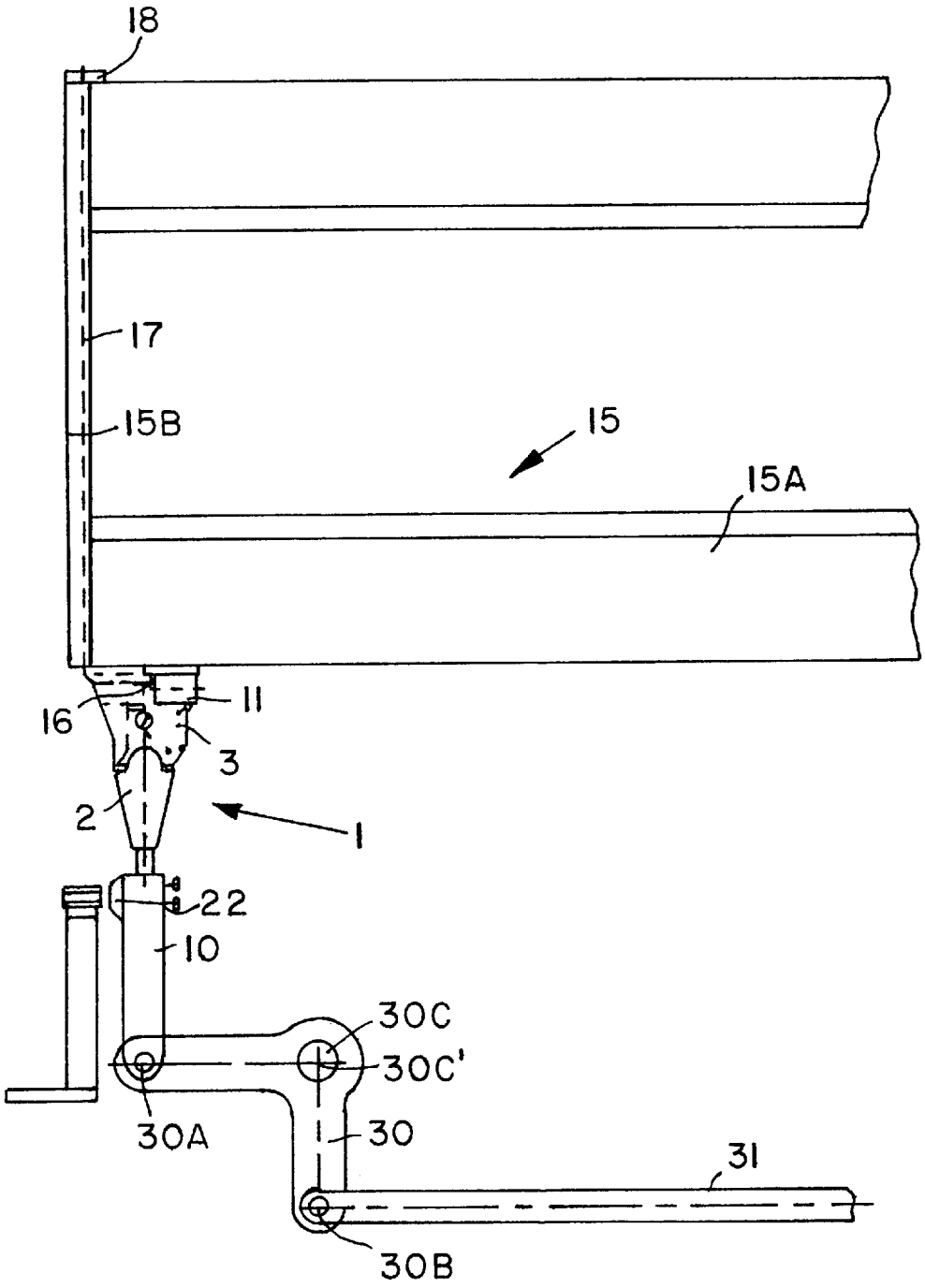
FIG. 5 shows schematically a portion of the heald shaft with a connector for the power supply conduit or line leading to the decoupling mechanism incorporated into the coupling section secured to the shaft side.

FIG. 5 shows an important embodiment of the invention in which the pressure supply line 17 between the coupler 16 at the decoupling mechanism 11 and the connector 18 passes through between spaces of neighboring shaft bars 15B of the heald shaft 15. The connector 18 may, for example, be a quick pressure hose coupler where the power supply is pneumatic or hydraulic for the slider unit 13, 14. Where the power supply is electric, the connector 18 will be part of an electric plug-in connector.

FIG. 5 further shows the coupling section 2 of the coupling unit 1 on the side of and connected to the shaft operating rod 10. Section 2 is shown coupled with the coupling section 3. The shaft operating rod 10, for example in the form of a push rod, is journalled to a first journal 30A at one arm of a rocker lever 30 which in turn is journalled on a journal 30C having a journal axis 33C'. The other arm of the rocker lever 30 is journalled to an end 30B of a pull rod 31 connected to a heald shaft drive not shown. The rocker lever 30 functions as a translation lever and is tiltable about the journal axis 30C' of the journal 30C. One such force transmitting link including a rocker lever 30, a pull rod 31, and a shaft operating rod 10 is provided for each heald shaft and the respective journals 30A, 30B, 30C are formed by the respective rocker lever 30. All rocker levers 30 are journalled on a single axle which thus forms a journal axis for all the rocker levers 30.

FIG. 6 shows a multitude of coupling sections 3 each combined with its own decoupling mechanism 11 according to the invention arranged in a row on the operating rod side and connected to the respective shaft operating rod 10. Each decoupling mechanism 11 has its own connector 16 connecting the respective pressure supply hose or flexible duct 17 to the pressure medium distributor 19 which in turn is connected through the control or shut-off valve 20, pressure conduit 21 and coupler 21A to the pressure source P as described above.

Figure 7:
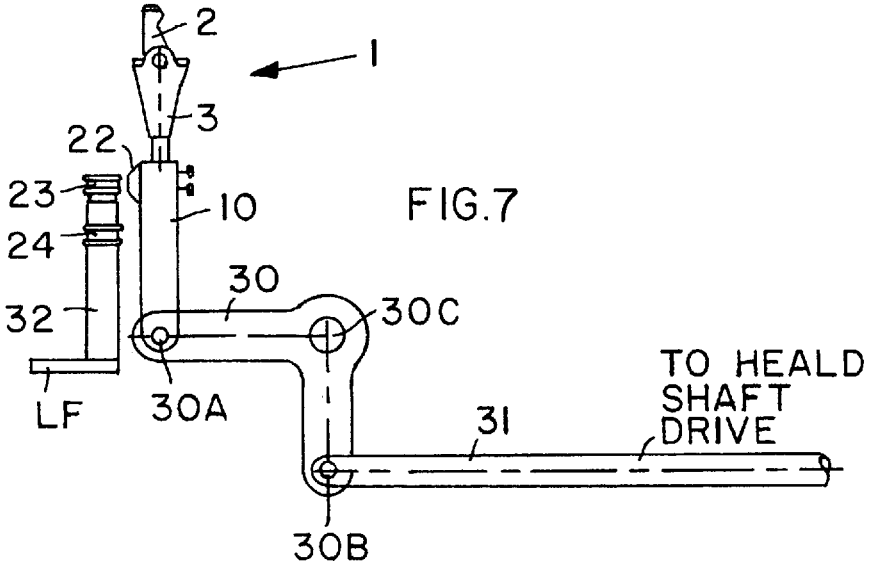
FIG. 7 illustrates an operating rod, specifically a push rod in a position ready for coupling and operatively tied to a mounting connected to the loom frame.

FIG. 7 is a view similar to the lower portion of FIG. 5. Each shaft operating rod 10 in the form of a push rod is equipped with a holding component such as a projection 22 below the respective coupling unit 1. Each holding projection 22 cooperates with a first holding device 23 or with a second holding device 24. Both holding devices 23 and 24 are secured to a carrier or mounting 32 which in turn is rigidly mounted to the loom frame LF. The mounting 32 with its holding devices 23 and 24 extends within the loom along a multitude of coupling units 1 arranged in a row and including coupling sections 2 or 3 and components 11 and 10, 30 and 31 forming outer left-hand heald frame motions. The holding devices 23, 24 are constructed as magnets, clamping devices or holding fingers or the like.

It is the purpose of the holding devices 23 to hold or arrest all active operating push rods 10 in a position ready for coupling or decoupling when it becomes necessary to couple or decouple the heald shafts 15 from or with the shaft motions. Stated differently, these holding devices keep the respective push rods that must be coupled to or decoupled from the heald shafts in such a position that the coupling or decoupling is possible. The holding device 24 keeps all passive push rods in an arrested position. The term "passive push rods" means all push rods 10 which are not coupled to heald shafts as shown in FIG. 8 during weaving of a pattern not requiring heald shaft motions of these particular heald shafts connected to passive operating rods.

Figure 8:
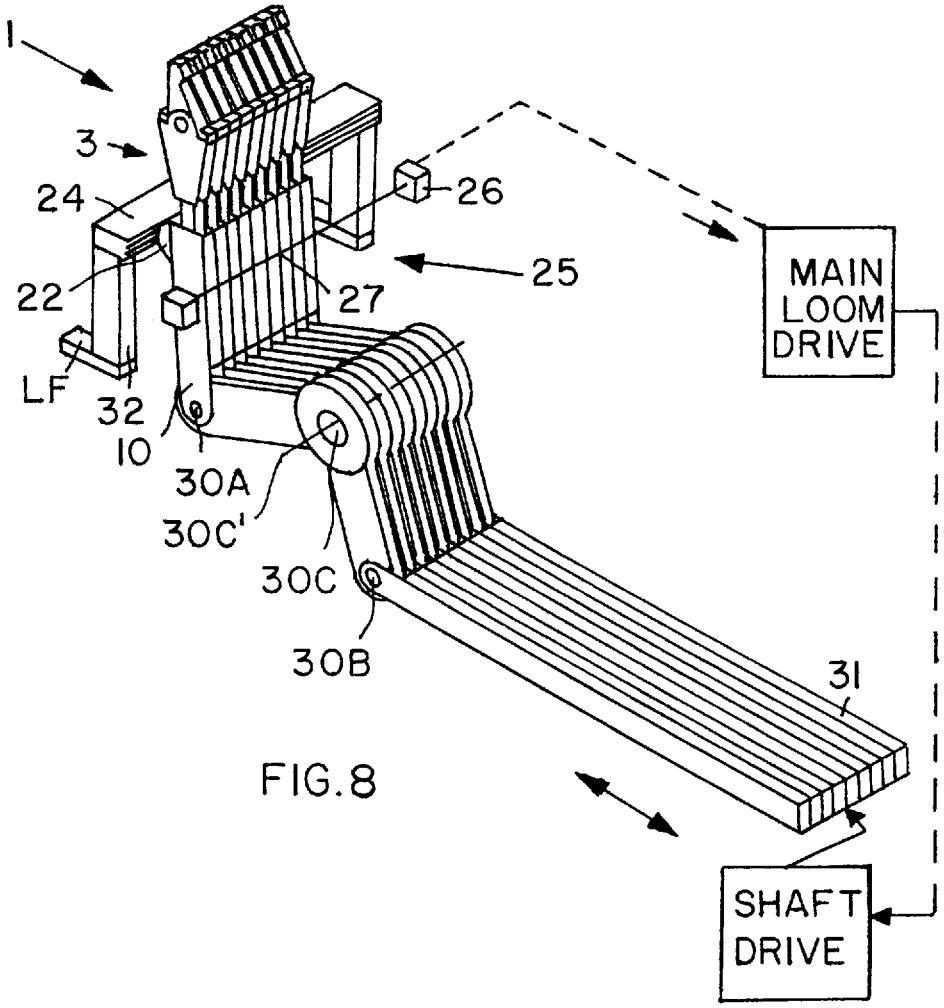
FIG. 8 is a perspective view of operating rods, more specifically push rods, in their rest position and operatively connected to a mounting secured to the loom frame with a safety device which limits the tilting range of the push rods between the safety device and the mounting.

FIG. 8 shows a multitude of passive, shaft operating rods 10 operable as push rods and having projections 22 for arresting the shaft operating rods 10 by a holding device 24, for example, in the form of an electromagnet or a permanent magnet. As mentioned above, the holding devices 23 and 24 in FIG. 7 and the holding device 24 in FIG. 8 may also be constructed as magnets or clamping devices or holding fingers or the like.

It is possible that the programmer of a weaving pattern has made an error so that contrary to the intended pattern program one or more passive shaft motions are activated by the shaft drive. Such an error, if not corrected by a respective error recognition device and when the loom drive is not stopped, leads to the destruction of or at least to substantial damages to the functional components of the loom.

According to the invention safety devices 25 are provided for monitoring the passive push rods 10. Such a safety device 25 may, for example, comprise an optical-electrical barrier sensor which monitors a tilting range provided between the holding devices 23, 24 on the one hand and the position of the safety device 25 on the other hand as represented by a straight line 27 forming, for example a light beam in FIG. 8.

If the light beam 27 of the opto-electrical barrier is unintentionally interrupted, a signal is provided to the main loom control to stop the main loom drive. Where the operational conditions are such that the intended purpose can be better achieved by mechanical sensors forming the safety device 25, the line 27 may represent a rigid or flexible rod that triggers a switch 26 when it is bent out of its straight position by an unintentionally activated push rod 10. A respective signal is then produced as by the light barrier to thereby stop the main loom drive. The switch 26 may be a mechanical switch or a light sensor.

Although the invention has been described with reference to specific example embodiments, it will be appreciated that it is intended to cover all modifications and equivalents within the scope of the appended claims.

What is claimed is:

1. A coupling and decoupling system for heald shafts in a loom in which said heald shafts are driven by operating rods (10), said system comprising a first coupling section (2) and a second coupling section (3) constructed for coupling to and decoupling from each other, a lever mechanism (6, 7) for coupling said first and second coupling sections (2, 3) to each other, a decoupling device (11, 11A) constructed and positioned for moving said lever mechanism (6, 7) into a decoupled states and power drive means (17, 12) connected to said decoupling device (11) for positively moving said lever mechanism for decoupling said first and second coupling sections (2, 3) from each other, wherein said power drive means comprises a source (P) of pressure, connectors and at least one conduit for operatively connecting said source of pressure to said decoupling device, wherein said decoupling device (11) comprises a guide housing (13) connected to said source of pressure (P), and a slider (14) guided in said guide housing (13), said slider (14) including a first slider surface (14A) exposable in said guide housing to a pressurized medium from said source of pressure, said slider having a further slider surface (14B) opposite said first slider surface (14A), and wherein said lever mechanism comprises a rocker lever (7) having a free lever end (7B) and a biasing spring (5) for biasing said free lever end (7B) of said rocker lever (7) against said second slider surface (14B).

2. The system of claim 1, wherein said source of pressure is a pneumatic pressure source.

3. The system of claim 1, wherein said source of pressure is a hydraulic pressure source.

4. The system of claim 2, wherein said guide housing (13) comprises parallel walls forming a rectangular guide for said slider (14), wherein a stroke of said slider (14) is limited between an inside wall surface of said guide housing (13) and by a stop (S) to permit a limited tilting or rocker angle ($\alpha$) for said rocker lever (7) bearing against said further slider surface (14B), and wherein a rear wall of said guide housing (13) comprises at least one outer projection (13A) for connecting said guide housing (13) with said second coupling section (3).

5. The system of claim 1, wherein said guide housing (13) and said slider (14) each comprises a slotted cut-out (13B, 14C) in which said free lever end (7B) of said rocker lever (7) is laterally guided.

6. The system of claim 1, wherein said first coupling section is adapted to be connected to said heald shafts, and wherein said second coupling section is adapted to be connected to said operating rods or vice versa.

7. A coupling and decoupling system for heald shafts in a loom in which said heald shafts are driven by operating rods (10), said system comprising a first coupling section (2) and a second coupling section (3) constructed for coupling to and decoupling from each other, a lever mechanism (6, 7) for coupling said first and second coupling sections (2, 3) to each other, a decoupling device (11, 11A) constructed and positioned for moving said lever mechanism (6, 7) into a decoupled state, and power drive means (17, 12) connected to said decoupling device (11) for positively moving said lever mechanism for decoupling said first and second coupling sections (2, 3) from each other, wherein said decoupling device (11A) comprises an armature (12B), and wherein said power drive means comprise a solenoid (12) arranged for driving said armature (12B) for operating said lever mechanism through said armature to cause said decoupling, and wherein said lever mechanism comprises a rocker lever (7) having a free lever end (7B) and a biasing spring (5) for biasing said free lever end (7B) of said rocker lever (7) against said armature (12B) to maintain contact between said armature (12B) and said free lever end (7B).

8. A loom comprising a number of heald shafts a corresponding number of operating rods, a coupling unit positioned between each heald shaft and a respective one of said operating rods, each coupling unit including a first coupling section (2) connected to a respective operating rod of said operating rods (10) and a second coupling section (3) connected to a respective heald shaft of said heald shafts, each coupling unit further comprising a power operated decoupling device, each decoupling device including a supply line (17) for connection to a source of pressure, and wherein each supply line (17) is connected to a common pressure supply (19) which in turn is connected through a controllable closure valve (20) with a fluid pressure source (P).

9. A weaving loom comprising a number of heald shafts a corresponding number of operating rods, a coupling unit positioned between each heald shaft and a respective operating rod of said operating rods, each coupling unit including a first coupling section (2) connected to a respective operating rod of said operating rods (10) and a second coupling section (3) connected to a respective heald shaft of said heald shafts, each a coupling unit further comprising a decoupling device which in turn comprises a connector connectable to a power supply line, wherein said heald shafts (15) comprise shaft bars (15A) and lateral shaft sections (15B), wherein said second coupling section (3) is arranged on said respective operating rod and connected to said decoupling device, and wherein each heald shaft encloses at least a part of said power supply line of said decoupling device (11).

10. The loom of claim 9, wherein said part of said power supply conduit (17) is formed by said lateral shaft sections (15B) and/or by at least one of said shaft bars (15A).

11. The loom of claim 9, wherein said power supply line is a pressure conduit (17) and wherein said connector (18) is provided for each heald shaft (15), said connector (18) being adapted for connection to said pressure conduit (17).

12. The loom of claim 9, wherein said power supply line is an electrical cable, and wherein said connector is provided for each heald shaft, said connector being adapted for connection to said electrical cable.

13. The weaving loom of claim 9, wherein said power supply conduit is a pressure supply conduit, and wherein at least a portion of said pressure supply conduit passes through a part of said heald shaft.

14. A weaving loom comprising a number of active and temporarily passive operating rods, a corresponding number of heald shafts, a coupling unit positioned between each heald shaft and a respective one of said operating rods, each coupling unit including a first coupling section (2) connected to a respective operating rod of said operating rods (10) and a second coupling section (3) connected to a respective held shaft of said heald shafts, wherein each active operating rod of said active operating rods is connected through a respective coupling unit of said coupling units to a heald shaft of said heald shafts, said loom further comprising holding means (22, 23, 24) for holding said passive operating rods arrested in an inactive position within the loom, wherein said holding means comprise for each operating rod (10) at least one holding element (22), said holding means further comprising first and second fixed holding devices (23, 24) rigidly secured to said loom for holding said temporarily passive operating rods in said inactive position through said holding element.

15. The loom of claim 14, wherein said first and second fixed holding devices (23, 24) comprise at least one first (23) and one second (24) magnetic holder extending crosswise to said operating rods (10), and wherein said at least one holding element (22) is secured to its operating rod (10).

16. A weaving loom comprising a main loom drive and a shaft drive driven by said main loom drive, said weaving loom further including a number of heald shafts, a corresponding number of heald shaft couplings, and operating rods connectable to said heald shafts through said heald shaft couplings, wherein said operating rods comprise temporarily passive operating rods, a holding device (32) fixed to a loom frame (LF) for holding said temporarily passive operating rods, said loom further comprising an activatable safety device (25) for preventing an activation of said passive operating rods (10) by switching off said main loom drive in response to a faulty programming of said shaft drive.

17. The loom of claim 16, wherein the safety device (25) comprises a position sensor (27) positioned for monitoring a tilting range ($\alpha$) of said operating rods (10), said tilting range being located between said holding device (32) and said position sensor (27) of said safety device (25).

18. The loom of claim 17, wherein said safety device (25) comprises a switch (26) connected to said position sensor and to said main loom drive for switching off the main loom drive in response to a signal from said position sensor (27).

19. The loom of claim 17, wherein said position sensor is selected from a group consisting of a rigid sensor element, a flexible sensor element and a contactless sensor element (27) positioned crosswise to said operating rods (10).

* * * * *

UNITED STATES PATENT AND TRADEMARK OFFICE
CERTIFICATE OF CORRECTION

PATENT NO. : 5,810,055

DATED : Sep. 22, 1998

INVENTOR(S) : Haeussler et al.

It is certified that error appears in the above-identified patent and that said Letters Patent is hereby corrected as shown below:

Col. 7, line 30, after "decoupled" replace "states" by --state,--;
line 52, after "claim" replace "2" by --1--.

Col. 8, line 23, after "shafts" insert --,--;
line 44, after "each" delete "a".

Signed and Sealed this

Twenty-ninth Day of December, 1998

*Attest:*

Bruce Lehman

BRUCE LEHMAN

*Attesting Officer*

*Commissioner of Patents and Trademarks*